United States Patent [19]

Faillon et al.

[11] Patent Number: 4,933,594

[45] Date of Patent: Jun. 12, 1990

[54] ELECTRON COLLECTOR FOR ELECTRON TUBES

[75] Inventors: Georges Faillon, Meudon; Georges Mourier, Mareil sur Mauldre, both of France

[73] Assignee: Thomson-CSF, Paris, France

[21] Appl. No.: 294,292

[22] Filed: Jan. 6, 1989

[30] Foreign Application Priority Data

Jan. 13, 1988 [FR] France ..... 88 00299

[51] Int. Cl.[5] ..... H01J 25/00; H01J 23/027

[52] U.S. Cl. ..... 313/153; 315/5; 315/39.3; 333/248

[58] Field of Search ..... 313/153, 156; 315/4, 315/5, 5.35, 5.38, 5.52, 39.3; 333/21 R, 21 A, 33, 251, 252, 248

[56] References Cited

U.S. PATENT DOCUMENTS

| | | | |
|---|---|---|---|
| 2,869,018 | 1/1959 | Brewer et al. | 315/3.5 |
| 3,538,366 | 11/1970 | Glien et al. | 313/24 |
| 4,173,744 | 11/1979 | Faillon et al. | 333/33 |
| 4,306,174 | 12/1981 | Mourier | 315/4 |
| 4,549,111 | 10/1985 | Mourier | 315/4 |
| 4,563,615 | 1/1986 | Mourier | 315/39.3 |
| 4,567,402 | 1/1986 | Mourier | 315/39.3 |
| 4,571,524 | 2/1986 | Mourier | 315/4 |
| 4,585,965 | 4/1986 | Mourier | 315/39.3 |
| 4,591,799 | 5/1986 | Faillon et al. | 330/45 |
| 4,636,689 | 1/1987 | Mourier | 315/4 |
| 4,661,744 | 4/1987 | Mourier | 315/4 |
| 4,668,894 | 5/1987 | Barnett et al. | 315/5.52 |
| 4,733,131 | 3/1988 | Tran et al. | 315/5.14 |
| 4,749,906 | 1/1988 | Tran et al. | 315/5 |
| 4,827,192 | 5/1989 | Tran et al. | 315/5.39 |

FOREIGN PATENT DOCUMENTS

| | | |
|---|---|---|
| 491127 | 10/1951 | France . |
| 56298 | 9/1952 | France . |
| 1105382 | 11/1955 | France . |
| 1404711 | 5/1965 | France . |
| 2568057 | 7/1985 | France . |
| 819682 | 9/1959 | United Kingdom . |

*Primary Examiner*—Kenneth Wieder
*Attorney, Agent, or Firm*—Roland Plottel

[57] ABSTRACT

According to the invention, the conducting collector wall (23) on which the electrons are collected is surrounded by a coil winding (36) which is supplied with a periodically varying current, creating a slightly divergent axial magnetic field whose amplitude is periodically variable with time. The electron trajectories strike the collector wall at a grazing, nearly tangential angle, broadening the zone of impact, and the zone of impact is swept back and forth along the length of the collector, further spreading the power to be dissipated on a greater surface of the collector. Application to realization of very high power tubes or moderate power tubes with reduced collector dimensions.

7 Claims, 4 Drawing Sheets

ELECTRON COLLECTOR FOR ELECTRON TUBES

DESCRIPTION OF THE INVENTION

The object of the invention is an electron collector for electron tubes. Applications of the invention are in the construction of microwave tubes such as gyrotrons, klystrons, traveling wave tubes, etc.

Figure 1:
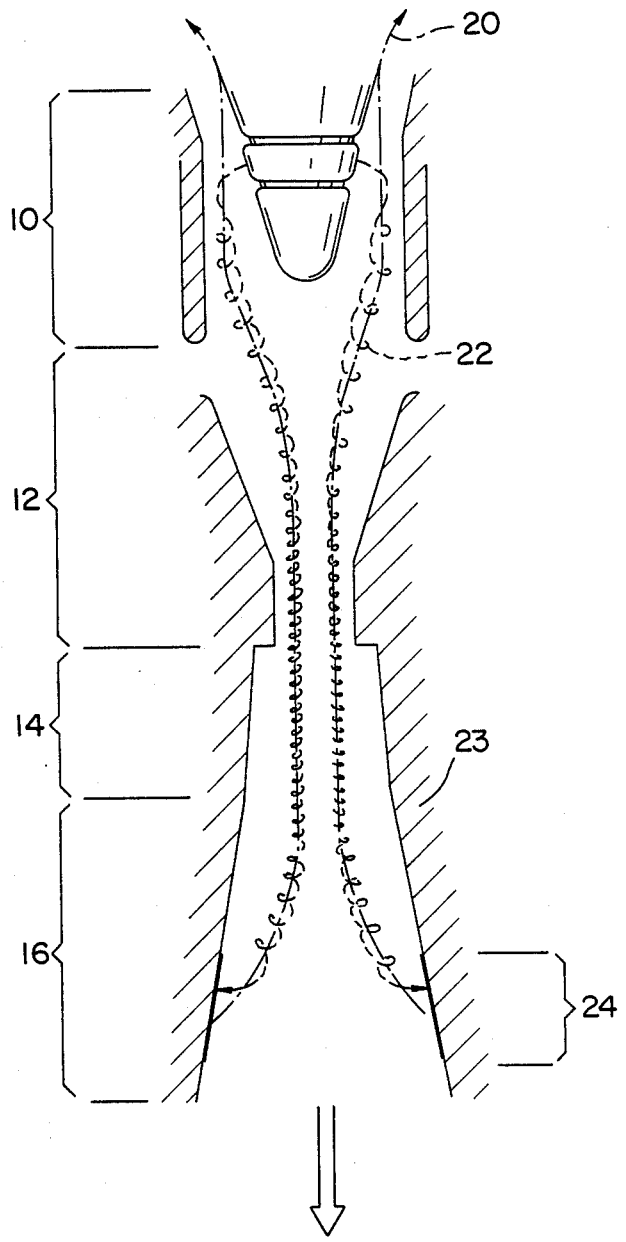
FIG. 1 PRIOR ART

A gyrotron is a microwave generator whose structure is shown schematically in FIG. 1. This structure includes an electron gun 10, a magnetic compression section 12, a cavity 14, and a collector 16 which also serves as an output waveguide.

A solenoid (not shown) creates a magnetic field 20 which forces the electrons coming from the electron gun to follow helical trajectories 22.

The extremity 16 of the gyrotron farthest from the electron gun consists of a metallic enclosure 23, which collects the electrons after their passage through the tube. This collection takes place in a ring-shaped section 24 of the collector wall. This ring-shaped section could have dimensions such as 10 cm high and 10 cm diameter, for example. For an electron beam carrying a power of 2 MW, the power density to be dissipated in a section of such dimensions would be 6.37 kW/cm2.

Such a power density requires strong cooling of the collector wall. This cooling is generally accomplished by circulation of water, using a large and costly apparatus.

One of the objects of the invention is to avoid the inconvenience of such an installation. To accomplish this, the invention introduces a device which allows to spread the zone of impact of electrons along the length of the collector wall, thus reducing the power density which must be dissipated per unit of surface on the collector wall.

This result is obtained by creating within the volume enclosed by the collector wall, a time dependent axial magnetic field, slightly divergent along the direction of the electron trajectories and periodically variable in magnitude.

The effect of such a divergent field is to cause the electrons to strike the collector wall at a grazing angle, nearly parallel to the wall. The zone of impact of the electrons is thus considerably lengthened. This spatial spreading effect can be combined with a periodic sweeping effect, obtained by periodically varying the amplitude of the axial magnetic field.

The magnetic field may be obtained by any appropriate method, for example by a coil winding which has a decreasing number of turns per unit length along the axis of the collector in the direction of the electron beam.

Said coil winding could have a truncated triangular form. The desired magnetic field shape could also be obtained using a cylindrical winding in combination with a conical winding, or by juxtaposition of windings with contant internal diameter but decreasing external diameter, etc.

In order to obtain the periodically time-variable field in a preferred embodiment of the invention, the current within the winding is composed of a DC steady-state component and a periodically alternating AC component.

In a preferred embodiment of the invention, the said periodically alternating AC component is of triangular wave form.

Figure 2:
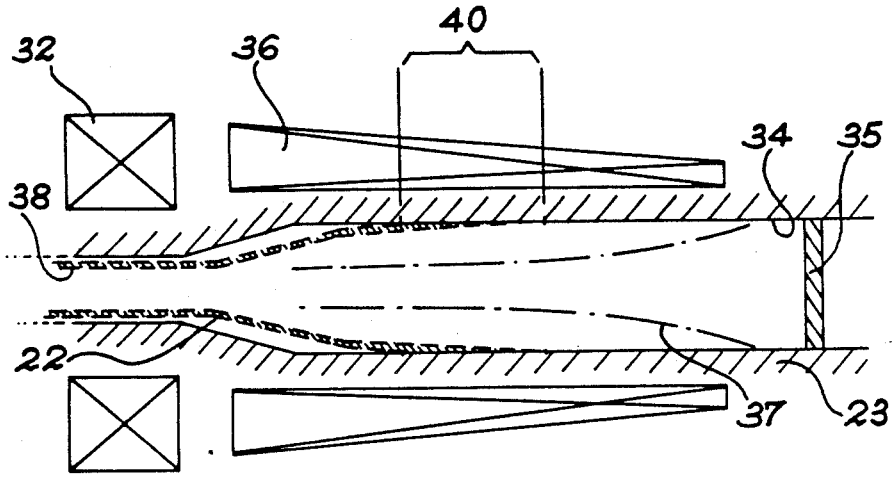
Figure 3:
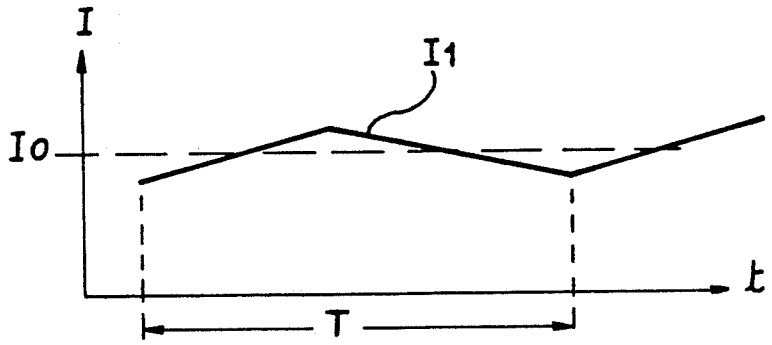
Figure 4:
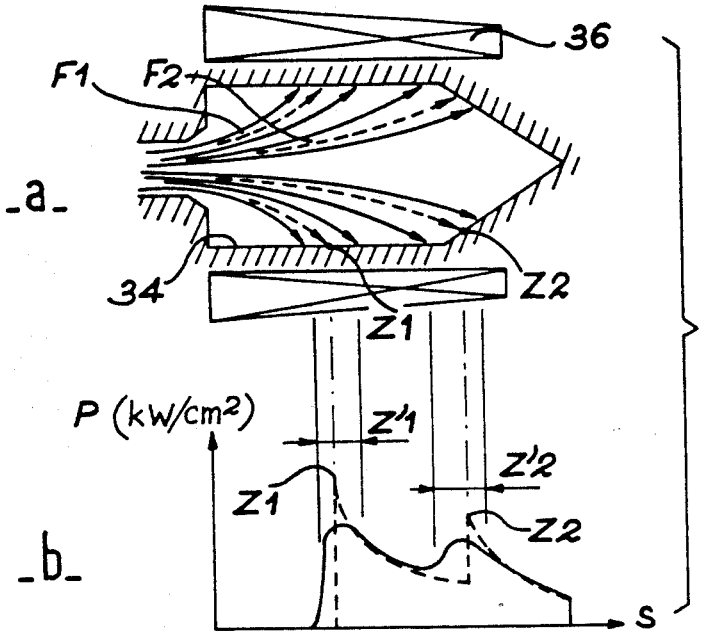
Figure 5:
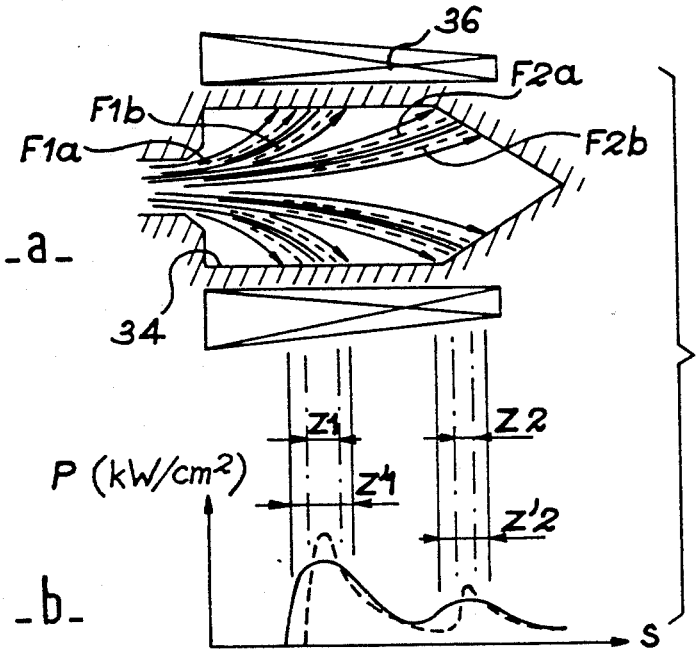
Figure 6:
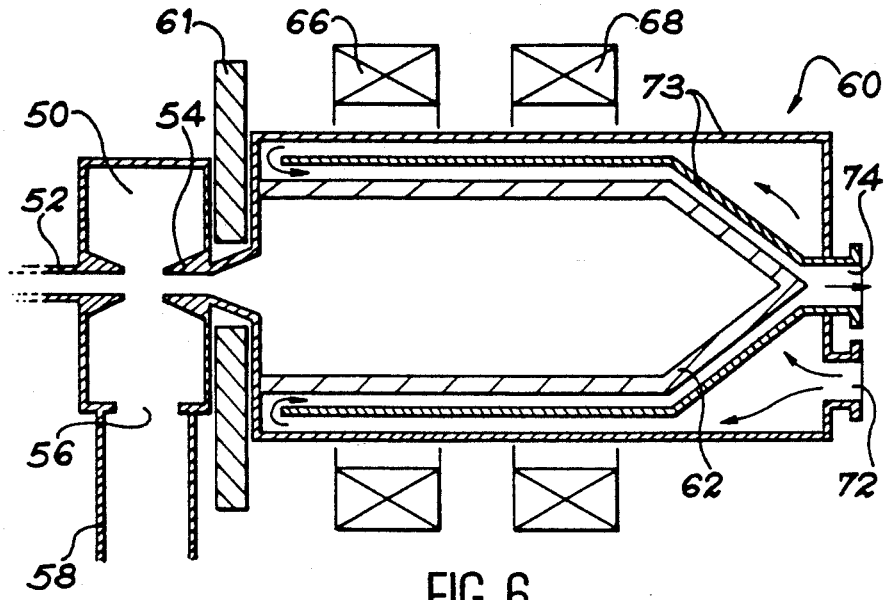
Figure 7:
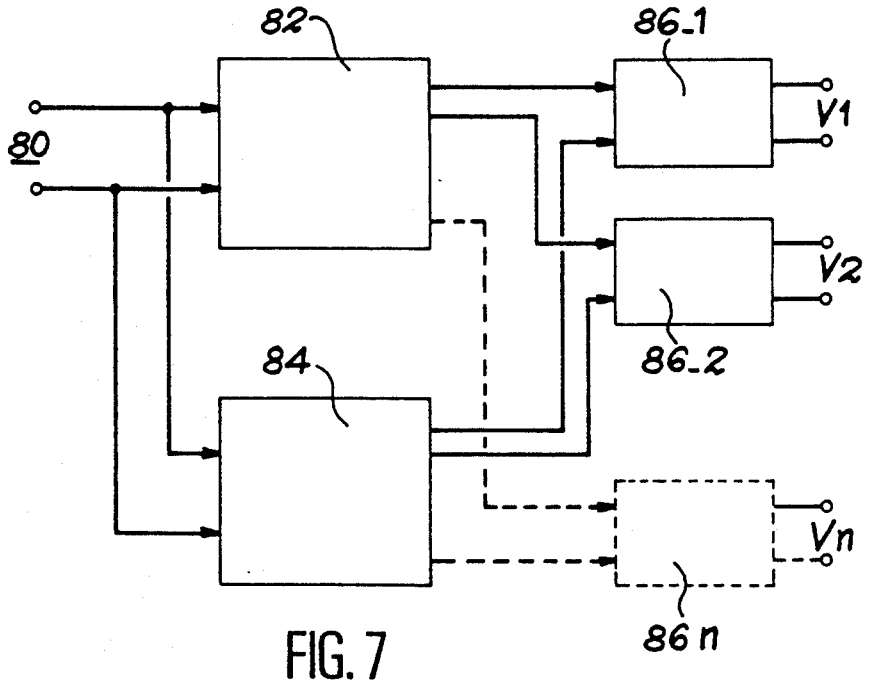

The invention can be used for all high power electron tubes such as klystrons, traveling wave tubes, etc. However it is particularly well suited for use with gyrotrons because the collector wall of a gyrotron is relatively thin, and because the geometry of the collector cannot be modified at will because it is also the output waveguide and must conform to specific dimensional criteria. The characteristics and advantages of the invention will be more clearly understood after the discussion which follows, illustrated with the following drawings which are given as examples only and are not to be considered as whatsoever limiting the concept and scope of the present invention:

FIG. 1, described above, represents a gyrotron according to the former art,

FIG. 2 represents the cross section view of a collector according to the invention, adapted for use with a gyrotron, FIG. 3 shows the preferred periodic variation of the current supplied to the coil windings, FIG. 4 shows a collector according to the invention, in a configuration adapted for use with a klystron, whose electron beam is not modulated, FIG. 5 shows a collector according to the invention, in a configuration adapted for use with a modulated-beam klystron, FIG. 6 shows a variation using two coil windings, FIG. 7 gives an example of a supply circuit for a device according to the invention using several coil windings.

The collector shown in FIG. 2 is the extremity of a gyrotron of which is shown only the main coil winding 32. The collector consists of a conducting wall 34, of a nearly cylindrical shape but widening slightly along its length in the direction of the propagation of the electron beam. The waveguide realized in this manner is closed at the extreme end by an output window 35 which is transparent to the electromagnetic wave generated by the device. According to the invention, the said collector wall is placed inside a coil 36 which, in the example illustrated, is unique and presents a cross section in the form of a truncated cone. A coil winding of this geometry creates a magnetic field which decreases slightly with increasing distance from the electron gun along the axis of the tube (towards the right in the FIG. 2). The magnetic induction lines 37 are thus slightly divergent in the direction of propagation of the electron beam (towards the right). In the other direction, the field lines join with the lines of the main winding 32.

Under such conditions, the electrons in the electron beam 38 propagate in spiral trajectories would about the field lines; the beam will spread slightly and strike the wall 23 at a grazing angle, nearly tangentially. The zone of impact 40 is thus considerably lengthened and the power density on the collector diminished.

In addition, as the current I supplied to the coil winding(s) 36 consists of a continuous DC steady-state component Io and an periodically alternating AC component I1, as shown in FIG. 3, the zone of impact is swept along the length of the collector in a periodic fashion, with the period of the AC component I1. With a judicious choice of current values and thus resulting magnetic field strengths, the beam can be made to sweep over the entire surface of the internal wall of the collector, thus reducing the power density per unit area of collector surface even further.

In a preferred configuration such as shown in FIG. 3, the periodic AC component I1 is a signal of triangular wave form of period T, however other signal wave forms of the AC component would also be acceptable, for example a sawtooth, square or sinusoidal waveform.

The time required for the magnetic field to penetrate or exit a collector wall of thickness d is of the order of $(d^{\frac{1}{2}})/140$ seconds where d is in cm. Likewise, for the heat transfer, the time to propagate through a thickness d is of the order of $d^{\frac{1}{2}}$ seconds. For a collector of 1 cm thickness, one can choose T=100 msec, which corresponds to a sweep frequency of 10 Hz. During this period T, the magnetic field can enter and exit the collector, while the collector wall will be cooled in a manner which is virtually constant with time. In the collector of tubes of the klystron type, the beam diverges more rapidly than in a gyrotron. However the problem remains the same, as there will be certain areas of the collector wall where the power densities to be dissipated are very high, in some cases exceeding 1 kW/cm2 continuous or average power. This situation could compromise the service lifetime of the tube (increase of crystal size, degassing, local melting, etc.), even in the presence of reasonably efficient cooling methods (fast water flow of several meters per second, hypervapotron with flow speed of the order of a meter per second, etc.).

For many microwave tubes, the power density and associated risks are reduced by increasing the diameter of the collector, however in the case of very large klystrons this solution quickly reaches practical limits of sheer massive size.

The invention allows, by addition of the coil winding as described above, to spread the beam over the largest possible area of the collector, thus reducing the power density to be dissipated and the local heat transfer necessary for cooling, as represented in FIGS. 4 and 5.

FIG. 4 shows schematically a collector 34 adapted to use with a klystron (part a) with electron beams F1 and F2, with a power density to be dissipated of P in kW/cm2, for example, over the length of the collector (part b).

The points Z1 and Z2 shown on the dotted curve in the part b correspond to the former art. These points are eliminated or greatly smoothed by using the invention, giving the impact zones Z'1 and Z'2 described by the solid lines.

The FIG. 4 corresponds to the case where the beam is not modulated by an RF signal; in other words, the klystron operates as a diode, and the input cavity is not excited. This type of operation is encountered during RF system setup, installation or trouble-shooting, during certain moments of the cycle of scientific machines (synchrotron, plasma fusion tokamaks, etc.), or in a telecommunications transmitter operating at low capacity because of small telecommunications traffic. If, on the other hand, the electron beam is modulated, the impact zone already sweeps a surface of the collector at the modulation frequency, although the area swept may be more or less large. The invention allows to spread the area swept by the impact zone even more, as illustrated in FIG. 5, spreading the zones indicated by the dashed lines Z1 and Z2 into the wider zones Z'1 and Z'2 indicated by the solid lines. It is thus possible to build very high power tubes using the invention to avoid the problems previously mentioned, or to construct tubes having more modest power levels but with relatively smaller collector dimensions.

FIG. 6 illustrates an example of a collector according to the invention, for application to the case of a klystron, which includes an output cavity 50 with two drift tubes 52 and 54, an output iris 56 and an output waveguide 58. The collector 60 is separated from the klystron by a plate 61, and comprises a conducting wall 62 surrounded by two coil windings 66 and 68 whose shape is appropriate to create a divergent magnetic field. These coils are supplied either in phase or out of phase with each other. Cooling means are provided, including a cooling liquid input 72 (for water cooling, for example), a watertight enclosure 73 which confines the water to flow through a labyrinth water circuit to the output 74.

A possible electrical power supply circuit for a device using several coil windings is represented in FIG. 7. A line input 80, either monophase or triphase, supplies a rectifier 82 and a synchronization and trigger generator 84. Monophase waveform generators 86-1, 86-2, . . . , 86-n receive a DC supply voltage from the rectifier 82 and a synchronization signal from the synchronization generator 84. These waveform generators deliver voltages V1, V2, . . . , Vn which include an alternating component differing in phase from the following waveform generator output. These voltages are then applied to the n coil windings of the collector according to the invention.

What is claimed is:

1. An electron collector for electron tube, said collector comprising a conducting wall (23) which receives on its internal surface an electron beam (22) coming from said electron tube (10,12,14), on an impact zone in the form of a ring whose height along the axis of the collector is small compared to the length of the collector along its axis, said collector further comprising, at least one coil winding (36) surrounding the collector wall and coaxial to the collector axis, said coil winding carrying a periodically varying electrical current, said coil winding and said periodically varying electrical current appropriate for creating an axial magnetic field (37) slightly divergent in the direction of travel of said electron beam, the amplitude of said axial magnetic field varying periodically with time.

2. A collector according to claim 1, wherein said coil winding (36) comprises a number of turns per unit length which decreases along the length of the collector in the direction of travel of the electron beam.

3. A collector according to claim 2, wherein said coil winding (36) has the form of a truncated cone.

4. A collector according to claim 1, wherein said electrical current carried by said coil winding (36) comprises a continuous DC part (Io) and a periodically variable AC part (I1).

5. A collector according to claim 4, wherein said periodically variable part of said electrical current is of a triangular waveform.

6. A collector according to claim 1, wherein said coil winding consists of a set of juxtaposed coil windings (66,68).

7. A collector according to claim 6, wherein said coil windings are supplied with an electrical current comprising a continuous DC part superimposed on an alternating AC part, said alternating AC part varying in phase from one coil winding to the next.

* * * * *